US008929503B2

(12) United States Patent
Zhuikov et al.

(10) Patent No.: US 8,929,503 B2
(45) Date of Patent: Jan. 6, 2015

(54) METHOD FOR PRODUCING RADIOSTRONTIUM

(75) Inventors: Boris Leonidovich Zhuikov, Troitsk (RU); Stanislav Viktorovich Ermolaev, Mytischi (RU); Vladimir Mikhailovich Kokhanyuk, Naro-Fominsk (RU)

(73) Assignee: Uchrezhdenie Rossiiskoi Akademii Nauk Institut Yadernykh Issledovany Ran (Iyai Ran), Moscow (RU)

( * ) Notice: Subject to any disclaimer, the term of this patent is extended or adjusted under 35 U.S.C. 154(b) by 327 days.

(21) Appl. No.: 12/919,527

(22) PCT Filed: Mar. 13, 2009

(86) PCT No.: PCT/RU2009/000124

§ 371 (c)(1), (2), (4) Date: Nov. 15, 2010

(87) PCT Pub. No.: WO2009/120110

PCT Pub. Date: Oct. 1, 2009

(65) Prior Publication Data

US 2011/0051873 A1 Mar. 3, 2011

(30) Foreign Application Priority Data

Mar. 27, 2008 (RU) ..... 2008111555

(51) Int. Cl.
*G21G 1/00* (2006.01)
*G21G 1/10* (2006.01)

(52) U.S. Cl.
CPC ..... *G21G 1/001* (2013.01); *G21G 1/10* (2013.01); *G21G 2001/0094* (2013.01)
USPC ..... 376/195

(58) Field of Classification Search
USPC ..... 376/195
See application file for complete search history.

(56) References Cited

U.S. PATENT DOCUMENTS 5,875,220 A * 2/1999 Zhuikov et al. ..... 376/195
6,456,680 B1 * 9/2002 Abalin et al. ..... 376/189

FOREIGN PATENT DOCUMENTS

EP 0578050 A1 1/1994
RU 2080878 C1 6/1997
RU 2102808 C1 1/1998
RU 2155398 C1 8/2000

OTHER PUBLICATIONS

Mausner, L. F., et al., "Production of $^{82}$Sr by Proton Irradiation of RbCl*", *J. Appl. Radiat. Isot.*, 1987, vol. 38, pp. 181-184.

(Continued)

*Primary Examiner* — Jack W Keith
*Assistant Examiner* — Sean P Burke
(74) *Attorney, Agent, or Firm* — Ladas & Parry LLP

(57) ABSTRACT

The invention relates to the production of radiostrontium. The problem to be solved by the invention is the extraction of radiostrontium from a large pool of liquid metallic rubidium to improve the efficiency of radiostrontium production and simplify the technology. Sorption is carried out directly on the inner surface of the target shell at a temperature of 275 to 350° C., or by means of extraction of radiostrontium from circulating rubidium via sorption on the heated surface of a trap at a temperature of 220 to 350° C., or by means of filtering liquid rubidium through a filtering unit made of a porous material resistant to liquid rubidium metal.

9 Claims, 5 Drawing Sheets

(56) References Cited

OTHER PUBLICATIONS

Zhuikov, B. L., et al., "Production of strontium-82 from rubidium metal target on a proton beam having the energy of MeV", *Radiojhimia*, 1994, vol. 36, Issue 6, pp. 494-498.
Zhuikov, B. L., et al., "Production of Strontium=82 in Russia", *Proc. 6th Workshop on Targetry and Target Chemistry*, Aug. 17-19, 1995, Triumf, 3 pages.
Phillips, D. R., et al., "Production of strontium-82 for the Cardiogen® PET generator: a project of the Department of Energy Virtual Isotope Center", *J. Radiochim, Acta*, 2000, vol. 88, pp. 149-155.
Zhuikov V.L. Poluchenie strontsiya-82 iz misheni metaliicheskogo rubidiya na puchke protonov s energiei 100 Mev Radiokhimiya, St.Peterburg, "Nauka", 1994, vol. 36, issue 6, p. 496, paragraph 3-7, figure 3.

* cited by examiner

METHOD FOR PRODUCING RADIOSTRONTIUM

FIELD OF THE INVENTION

The invention relates to nuclear technology and radiochemistry, namely, to the production and extraction of radioactive isotopes for medical purposes. More specifically, the invention relates to the production of radiostrontium isotopes $^{82}$Sr and $^{85}$Sr, the former being widely used in medicine to diagnose a number of diseases with the use of positron emission tomography.

BACKGROUND OF THE INVENTION

A process is known in prior art to be used for the production of radiostrontium [see L. F. Mausner, T. Prach, S. C. Srivastava, J. Appl. Radioat. Isot., 1987, vol. 38, pp. 181-184], this process comprising the bombarding of targets made of rubidium chloride with beams of accelerated charged particles and the radiochemical extraction of radiostrontium therefrom. The limited productivity of this process is due to the low contents of the working body (rubidium) in the material and to the properties of the material to be irradiated: the low heat conductance of RbCl leads to high temperatures inside the target when it is bombarded with an intense beam of particles, inducing radiolysis of RbCl and corrosion of the target shell by nascent chlorine.

Another process is also known to produce radiostrontium [see B. L. Zhuikov, V. M. Kokhanyuk, V. N. Gluschenko, et al., Radiokhimiya, 1994, vol. 36, pp. 494-498; B. L. Zhuikov, V. M. Kokhanyuk, N. A. Konyakin, A. A. Razbash, J. Vincent, Proc. 6th Workshop on Targetry and Target Chemistry, Vancouver, Canada, 1995, TRIUMF, Vancouver, 1996, Ed. by J. M. Liuk, T. J. Ruth, p. 112; D. R. Philips; E. J. Peterson, W. A. Taylor, et al., J. Radiochim. Acta, vol. 88, pp. 149-155], this process comprising the bombarding of a target made of metallic rubidium having a weight of up to 50 g with a beam of accelerated particles and the radiochemical extraction of radiostrontium therefrom by means of dissolution of the metallic rubidium in an alcohol, conversion of the products to an aqueous solution of chlorides, and ion exchange. The high heat conductance of metallic rubidium makes it possible to bombard thick targets with intense beams of particles, rendering this process efficient for producing large amounts of $^{82}$Sr (in Ci units). The shortcoming of this process consists in the complexity, length, and hazard of the radiochemical extraction of radiostrontium. In the context of a feasibility of a large-scale radiostrontium production from far bulkier metallic rubidium targets in a broad high-intensity beam, this approach seems even unrealistic.

The most pertinent piece of prior art for the invention consists of the process for producing radiostrontium [see B. L. Zhuikov, V. M. Kokhanyuk, J. Vincent, patent RU 2102808 C1, 1998] comprising the bombarding of metallic rubidium targets with a beam of accelerated charged particles, melting of the irradiated rubidium, and the extraction of radiostrontium therefrom via sorption on the surface of various metals or oxides which are immersed into the molten metallic rubidium. The major drawback of this process consists in that a considerable part of the radiostrontium formed in this way is lost, being sorbed on the walls of the container to which radiated rubidium is transferred and on the inner surface of the target shell, specifically, when high-intensity beams are used for bombarding. For instance, for proton currents on the order of 0.5 to 1 μA, the inner surface of the target shell sorbs 10 to 30% of the resulting radiostrontium; when the current intensity increases, this percentage loss reaches 50 to 70%.

DISCLOSURE OF THE INVENTION

The problem to be solved by the invention is to separate radiostrontium from a great pool of liquid metallic rubidium via sorption directly on the inner shell of the target, or extract radiostrontium from circulating rubidium via sorption on a heated surface, or via filtration of liquid rubidium, thereby enhancing the efficiency of radiostrontium production and simplifying the technology. The technical result is reached as follows: in the process for the production of radiostrontium comprising the bombarding, by an accelerated particle beam, of a target containing metallic rubidium enclosed in a target shell, melting of the rubidium inside the target shell after bombarding, and extraction of radiostrontium therefrom via sorption on the surface of various materials contacting with the liquid rubidium, radiostrontium is extracted from the liquid metallic rubidium via sorption directly on the inner shell surface of the irradiated target by means of exposure of the hermetically sealed target at temperature of 275 to 350° C. Useful shell materials represent stainless steel, tantalum, niobium, tungsten, molybdenum, nickel, or noble metals. Further, the metallic rubidium is pumped from the target to leave 96±4% radiostrontium sorbed on the inner surface of the target shell. Then, the radiostrontium may be solubilized by pouring into the target various solvents, for example, organic alcohols, water, and/or aqueous solutions of mineral acids, and others. The simplest and most technological way to accomplish washing is first with water and then with mineral acids.

Another variation of the invention consists in that, as the working body, use is made of liquid rubidium which is circulating during irradiation through a closed loop equipped with a trap. There are two methods for extracting radiostrontium. One method consists of radiostrontium sorption on the surface of metallic rods heated to 220 to 350° C. and immersed into liquid rubidium, for example, on the surface of metallic rods in a trap, these rods being made of stainless steel, tantalum, niobium, titanium, zirconium, tungsten, molybdenum, nickel, or precious noble metals. The temperature of the rubidium circulating through the loop is maintained in the range of 10 to 220° C., and the content of oxygen in the rubidium does not exceed 3% by weight. The other method extracts radiostrontium sorbed on sol particles (a solid phase) contained in the liquid rubidium, by means of a filter, this filter being a porous membrane made of, for instance, a metal that is inert with respect to rubidium, the oxygen content of the circulating rubidium being maintained in the range of 0.1 to 4.0% by weight via adding oxygen or rubidium. The temperature is selected from the range of 10 to 38° C. so that a certain ratio of the solid and liquid phases to be maintained. Next, radiostrontium is washed from the surface of the rods or filter with organic alcohols, water, and/or aqueous solutions of mineral acids. This variation allows radiostrontium to be extracted from rubidium pools weighing kilograms with simultaneous bombarding thereof by a beam of accelerated high-intensity protons (of several hundreds of microamperes).

In oxygen-containing rubidium, oxygen can occur (depending on its concentration) in the form of either dissolved species or rubidium oxide colloidal particles. The radiostrontium generated by the bombarding occurs in rubidium in the form of a true solution or is sorbed on the surface of rubidium oxide colloidal particles. Depending on the oxygen percentage content, the colloidal particles will either dissolve in rubidium or coarsen and precipitate in response to rising temperature.

BRIEF DESCRIPTION OF THE DRAWINGS

The process will be further illustrated with drawings and tables.

Table 1 shows the radiostrontium distribution in rubidium along the height of a vertically positioned container which represents a glass cylinder having an inner diameter of 25 mm to which irradiated rubidium was transferred from the target shell. The radiostrontium concentration is expressed as the Sr activity at the end of bombarding per unit weight of irradiated rubidium. One can see that most radiostrontium precipitates together with rubidium oxide particles. Some radiostrontium is concentrated near the liquid rubidium surface which is in contact with the gas where oxygen is contained in a greater amount. Thus, for a certain concentration and for a certain size of colloidal particles that is determined by apparatus parameters, strontium can be transported with liquid rubidium avoiding considerable precipitation on the inner surfaces of parts of the loop.

Radiostrontium was sorbed on the inner target shell surface that was in contact with rubidium. From Table 2, it follows that most part of the radiostrontium was concentrated in the lower portion of the target on the surface of precipitated rubidium oxide particles, while the other part was distributed over the entire inner target shell surface.

Figure 1:
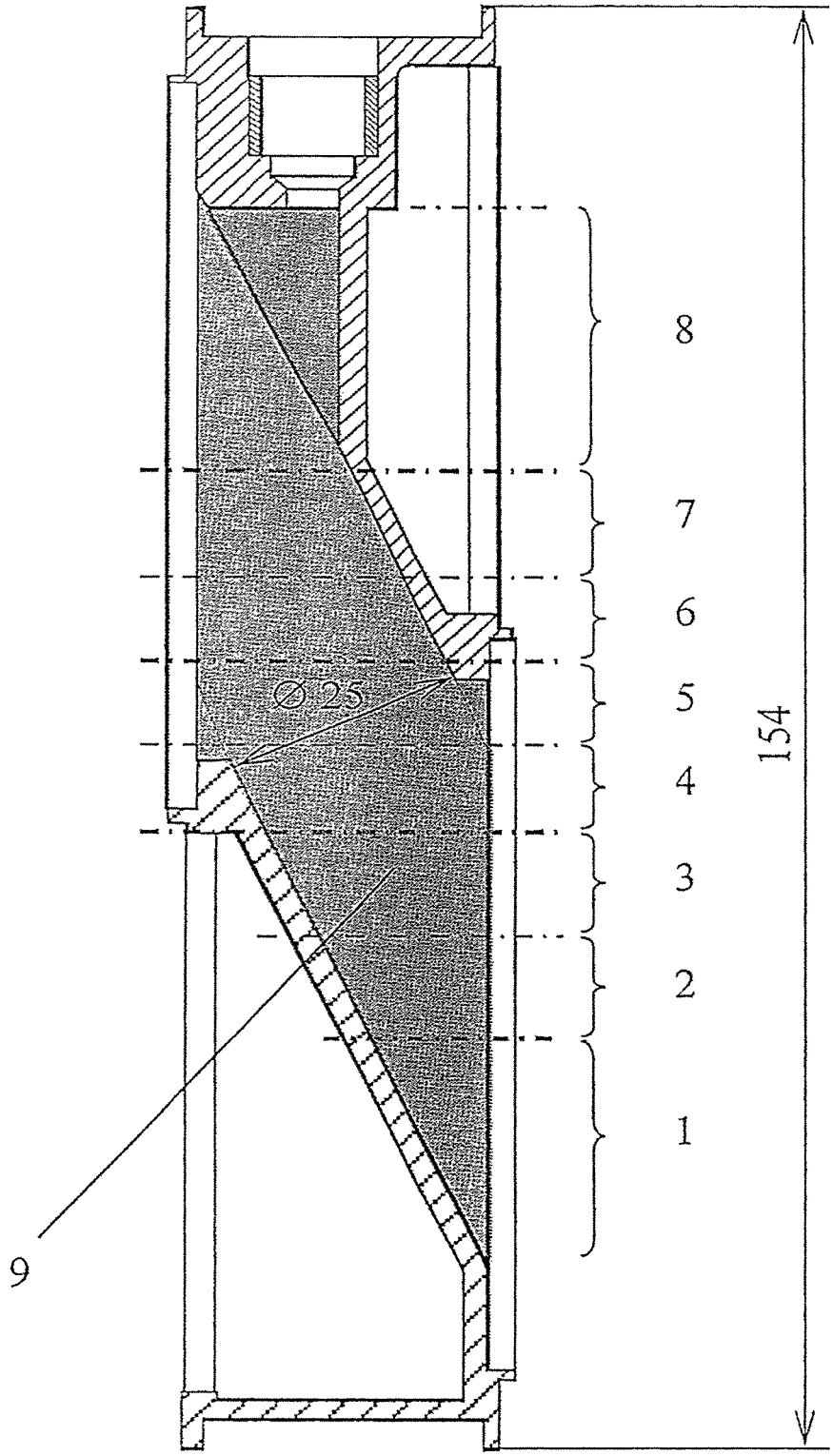
FIG. 1 shows an image of the shell of a target 35 mm in volume from which metallic rubidium has been removed after heating for 5 h at 275° C. (see Example 1).
Figure 2:
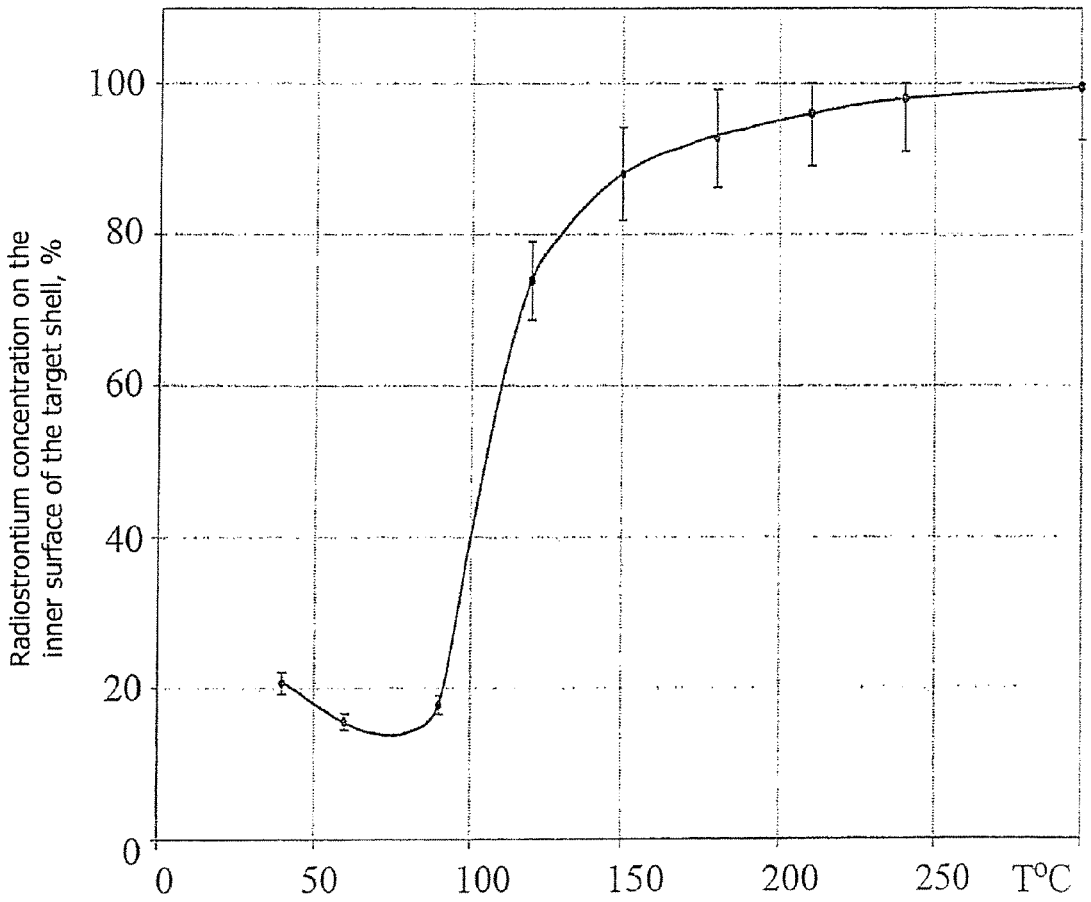
FIG. 2 shows radiostrontium sorption on the inner shell surface of an irradiated target (FIG. 1) as a function of stepwise rise in temperature.

FIG. 2 shows the degree of radiostrontium sorption on the inner surface of the irradiated target (FIG. 1) as a function of stepped temperature elevation; the heating time at each temperature is 3 h. At a relatively low temperature (of about 100° C.), adsorption is a reversible process; at 275° C. or above, there is a rather complete radiostrontium sorption, evidently as a result of the dissolution of rubidium oxide colloidal particles.

Figure 3:
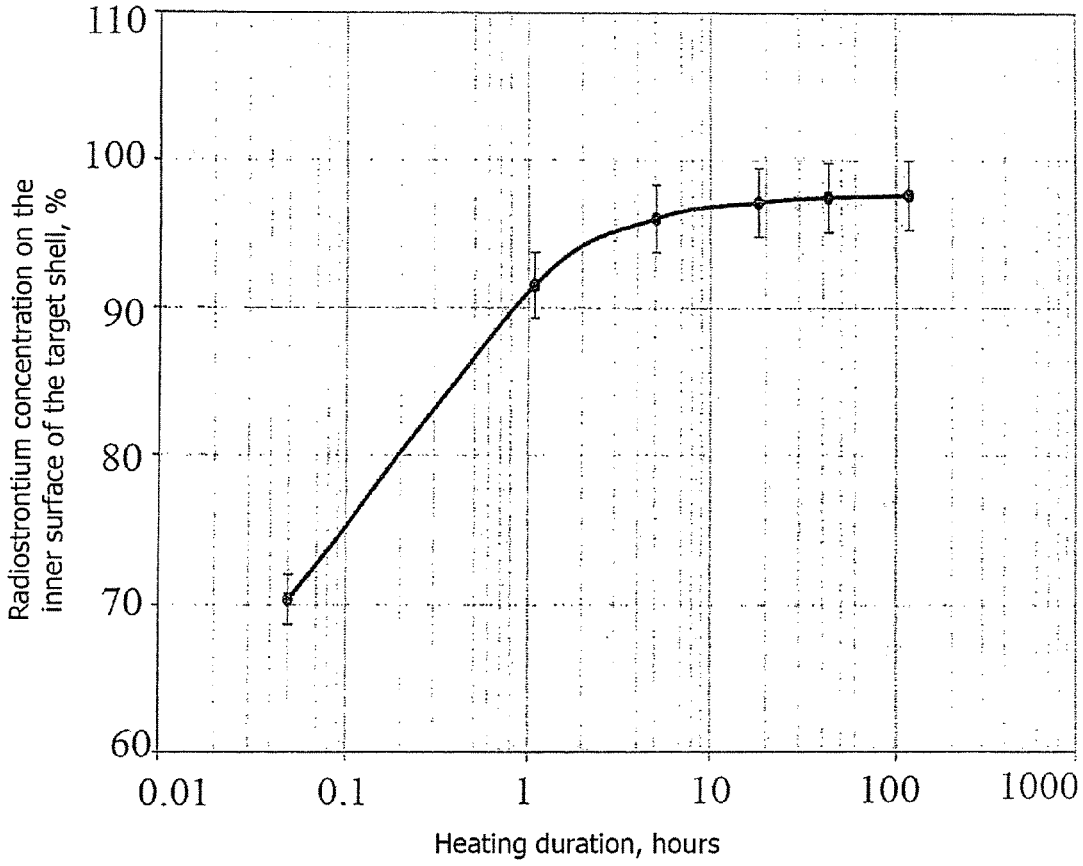
FIG. 3 shows radiostrontium sorption as a function of the time of heating the irradiated target at 275° C.

FIG. 3 represents radiostrontium sorption as a function of time of heating the irradiated target at 275° C. In 3 h of heating, about 95% of the radiostrontium is sorbed on the inner target shell surface.

Once sorption is over, liquid metallic rubidium is removed from the target and radiostrontium is washed with a solvent from the inner target shell surface. Table 3 shows the efficiency of radiostrontium washing with a solvent from the surface for targets of various volumes.

TABLE 1

Radiostrontium distribution in irradiated rubidium along the height of a vertically positioned container

| | Zone | | | | | | | | | | |
|---|---|---|---|---|---|---|---|---|---|---|---|
| | 1 | 2 | 3 | 4 | 5 | 6 | 7 | 8 | 9 | 10 | 11 |
| Container zone height, mm | 0-10 (bottom) | 10-20 | 20-30 | 30-40 | 40-50 | 50-60 | 60-70 | 70-80 | 80-90 | 90-100 | 100-110 |
| Radiostrontium concentration, μCi | 16.9 | 10.5 | 6.94 | 3.61 | 2.16 | 2.22 | 2.24 | 2.04 | 2.01 | 2.27 | 6.40 |

Table 2 displays the distribution of radiostrontium sorbed on the inner surface of the target shell shown in FIG. 1, along the target height after irradiated rubidium was removed. In FIG. 1, reference numbers 1 through 8 denote strontium sorption zones, and position 9 denotes the cavity of the target shell filled-in with rubidium.

TABLE 2

Distribution of remnant radiostrontium after irradiated rubidium was pumped out, over the inner surface of the target shell

| | Zone | | | | | | | | |
|---|---|---|---|---|---|---|---|---|---|
| | 1 | 2 | 3 | 4 | 5 | 6 | 7 | 8 | Total |
| Target zone height, mm | 0-24 | 24-35 | 35-46 | 46-56 | 56-65 | 65-74 | 74-85 | 85-115 | |
| Zone volume, ml | 2 | 3 | 5 | 5 | 5 | 5 | 5 | 5 | 35 |
| Radiostrontium fraction, % | 29.5 | 26.7 | 17.1 | 6.5 | 2.7 | 4.9 | 3.8 | 5.2 | 96.4 |

TABLE 3

| Results obtained on consecutive washing of radiostrontium out from the surfaces of steel target shells (sorption lasted 3 h) | | |
|---|---|---|
| Liquid composition | Surface treatment time | Radiostrontium washing, % |
| | Small target (13 ml) | |
| Butanol | 10 min | 71 ± 1 |
| Methanol | 10 min | 3 ± 1 |
| 0.1 M HCl | 10 min | 25 ± 1 |
| TOTAL: | | $99_{-2}^{+1}$ |
| | Small target (13 ml) | |
| Propanol | 10 min | 65 ± 2 |
| Distilled water | 10 min | 28 ± 2 |
| TOTAL: | | 93 ± 2 |
| | Small target (13 ml) | |
| 0.1 M HCl | 15 min | >99 |
| | Large target (35 ml) | |
| 0.5 M HCl | 30 min | 92 ± 2 |
| 0.5 M HCl | 30 min | 7 ± 1 |
| 0.5 M HCl | 30 min | <0.5 |
| TOTAL: | | >99.5 |

Figure 4:
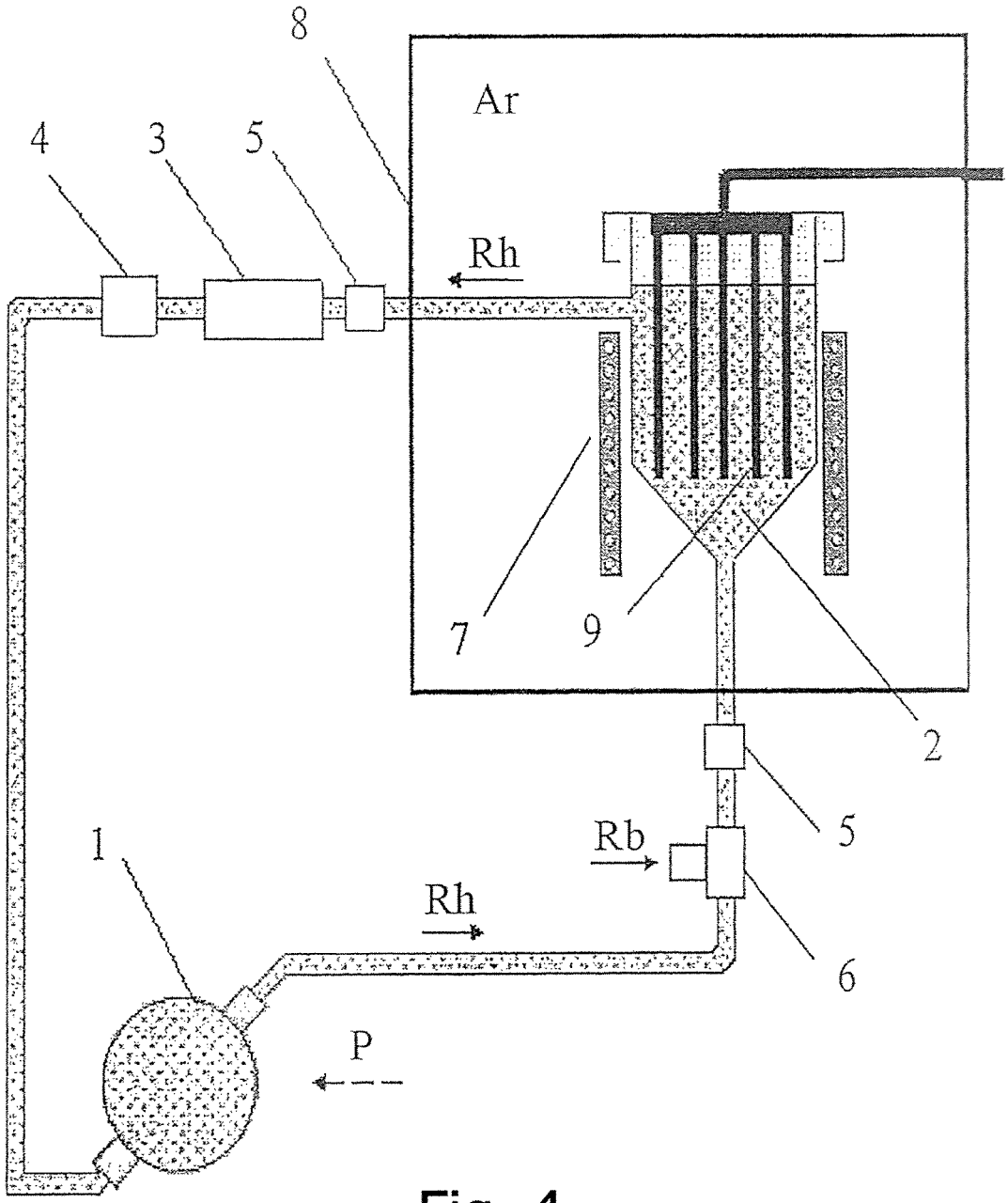
FIG. 4 shows a schematic representation of a variation of a setup proposed for the continuous production and extraction of $^{82}$Sr from a liquid metallic rubidium target.

The process proposed for the production of radiostrontium makes it possible to organize continuous production. FIG. 4 shows a schematic representation of a setup proposed for the continuous production and extraction of $^{82}$Sr from a liquid metallic rubidium target. Here, rubidium is circulating through the loop that comprises a continuously bombarded target 1 in a stainless steel shell and a trap 2 for the adsorptive extraction of Sr. The loop is equipped with an induction pump 3 for pumping liquid rubidium, a flow rate monitoring system 4, and a rubidium purity monitoring system 5 (standard solid-electrolyte pickups). The temperature of liquid rubidium in the loop is maintained within the range from 10 to 220° C. The rubidium melting temperature is 39° C., but it shifts down at a certain concentration of dissolved oxygen. The oxygen concentration in liquid metallic rubidium should not exceed 3% by weight in order for rubidium oxide precipitation to be inhibited. For this purpose, a means 6 is provided in the loop system for replenishing with metallic rubidium having a certain oxygen concentration. The trap 2 for radiostrontium equipped with a thermostat 7 is mounted inside a hot chamber 8 filled with an inert atmosphere. Sorbing rods 9 are heated by means of a heat conductor or built-in heaters for providing better radiostrontium sorption at temperatures of 220 to 350° C., and there is an option of heating central rods alone to minimize adsorption on the walls of the trap.

Figure 5:
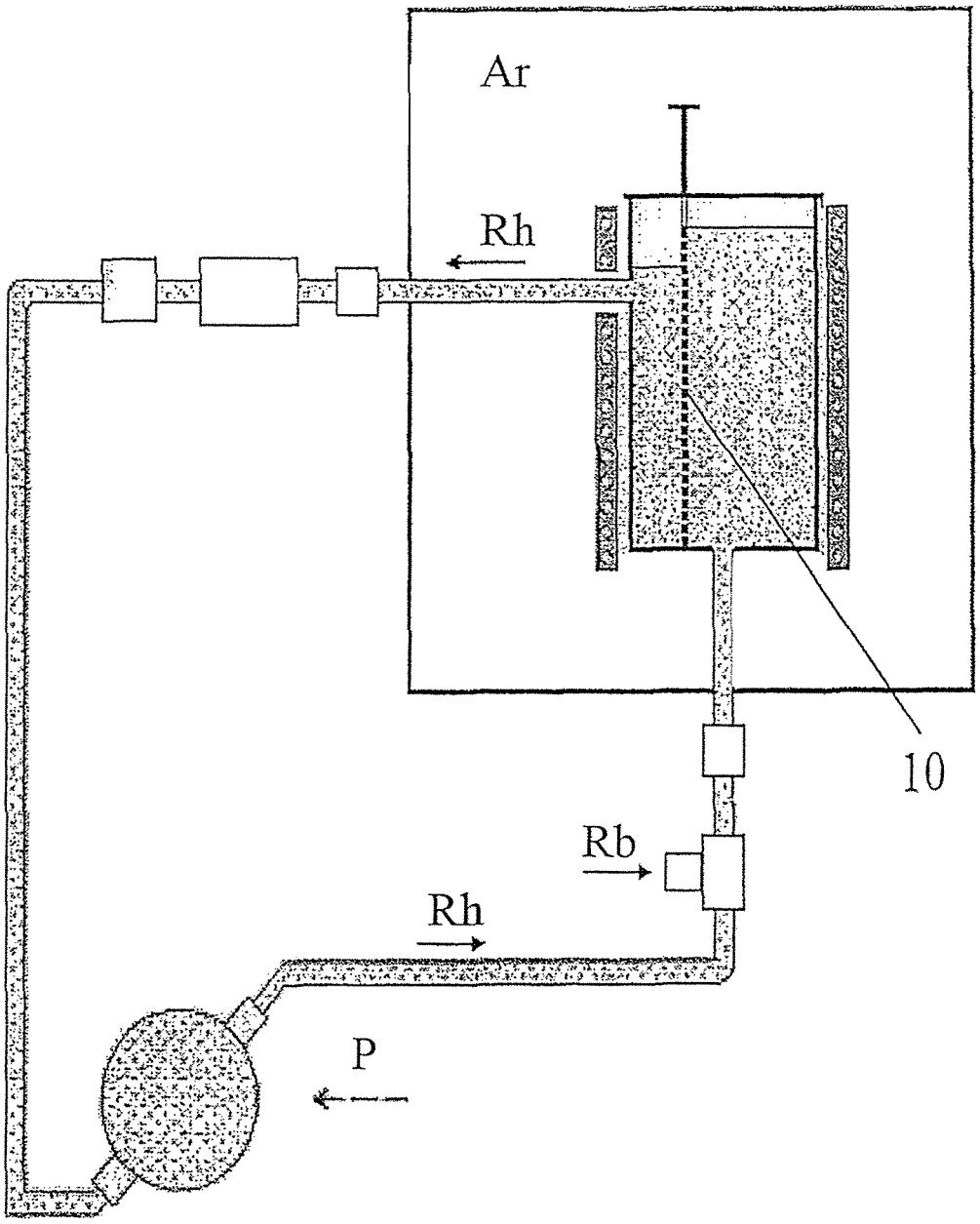
FIG. 5 shows a schematic representation of another variation of a setup proposed for the continuous production and extraction of $^{82}$Sr from a liquid metallic rubidium target.

A vertically positioned filter (a thin smooth metallic membrane 10) is also useful as a sorbing unit, as shown in FIG. 5, the membrane continuously filtering metallic rubidium and retaining radiostrontium-containing sol particles. In this case, the oxygen content of the circulating rubidium is maintained in the range of 0.1 to 4.0% by weight. Temperatures in various parts of the loop are selected from the range 10 to 38° C. so that to maintain a certain ratio between the solid and liquid phases. The sorbing units 9 (FIG. 4) and 10 (FIG. 5) are periodically withdrawn (optionally, even without arresting the beam and rubidium circulation). In an adjacent hot chamber, the withdrawn sorbing unit is washed with water and a solution (e.g., HCl) and dried to be then returned to the trap. The washes containing $^{82}$Sr are forwarded to further processing to produce the final product.

Further secondary refining of the extracted radiostrontium to free it from radionuclides and stable impurities is carried out by known radiochemical methods [see B. L. Zhuikov, V. M. Kokhanyuk, N. A. Konyakin, A. A. Razbash, J. Vincent, Proc. 6th Workshop on Targetry and Target Chemistry, Vancouver, Canada, 1995, TRIUMF, Vancouver, 1996, Ed. by J. M. Liuk, T. J. Ruth, p. 112; D. R. Philips, E. J. Peterson, W. A. Taylor, et al. // Radiochim. Acta, 2000, vol. 88, pp. 149-155].

EMBODIMENT OF THE INVENTION

For the better understanding of the claimed process for the production of radiostrontium, some specific examples are given hereinbelow.

EXAMPLE 1

A target containing 53 g of metallic rubidium was bombarded by a proton beam of 62 for 2 hours in the proton energy range of from 100 to 40 MeV. After two-week exposure, the target was heated at 275° C. for 5 hours and then cooled, after which irradiated rubidium was withdrawn from the shell at 46° C. 97.5% of the radiostrontium was found to remain on the inner surface of the shell. Then, radiostrontium was washed layer by layer from the inner surface of the shell, which is schematically shown in FIG. 1, with a 0.5 M HCl solution. The layer-by-layer washing was carried out by pouring the solution, each portion of the solution having a greater volume than the preceding one (first to reach the boundary of zone 1, then the boundary of zone 2, and so on). After pouring each portion, the poured solution was exposed for one hour and then pumped out. The radiostrontium distribution along the height of a large target obtained in this manner (Table 2) shows that most part of the radiostrontium is concentrated in the lower portion of the target on the surface of particles of rubidium oxide that has been first precipitated and then dissolved at higher temperature; the other part is distributed over the entire target shell surface. Next, all solution portions were combined. Comparison of radionuclide concentrations in the irradiated rubidium target and in the combined 0.5 M HCl solution demonstrates the selectivity of radiostrontium sorption (Table 4): purification occurs not only from rubidium but also simultaneously from selenium and arsenic isotopes.

TABLE 4

| Radionuclides contained in an irradiated rubidium target and in a 0.5 M HCl solution obtained by washing radiostrontium from the inner surface of the target shell, as calculated for the end of irradiation | | | | | |
|---|---|---|---|---|---|
| | Radionuclide composition, Bq/Bq $^{82}$Sr | | | | |
| | $^{83}$Rb | $^{84}$Rb | $^{86}$Rb | $^{75}$Se | $^{74}$As |
| Irradiated rubidium target | 1.3 | 2.4 | 1.2 | $7\text{-}10^{-3}$ | $8\text{-}10^{-3}$ |
| Radiostrontium solution | 0.014 | 0.024 | 0.014 | $2.5\text{-}10^{-3}$ | $8\text{-}10^{-4}$ |
| Purification factor | | 90-100 | | 3 | 10 |

EXAMPLE 2

A 50-g portion of metallic rubidium was placed in a target inside an air-tight shell made of stainless steel and bombarded with a proton beam of 0.5 μA for 1 hour in the proton energy range of from 100 to 40 MeV. After one-week exposure, the target was heated to 47±2° C., and then irradiated rubidium was withdrawn from the shell under a nitrogen atmosphere. 33% of the radiostrontium was found to remain on the inner surface of the shell. Another target containing 53 g of metallic rubidium was bombarded with a proton beam of 70 μA for 5 hours in the proton energy range of from 100 to 40 MeV. After one-week exposure, the target was heated to 46±2° C., then irradiated rubidium was withdrawn from the shell under a nitrogen atmosphere, and 64% of the radiostrontium was found to remain on the inner surface of the shell. This example shows that, at a relatively low temperature, radiostrontium sorption on the inner shell of the target is not so efficient compared to 275° C. as in Example 1.

EXAMPLE 3

A target containing 52 g of metallic rubidium was bombarded with a proton beam of 50 μA in the proton energy range of from 100 to 40 MeV. The overall proton charge amounted to 960 μA h. After three-week exposure, the target was placed in a furnace and heated at 320° C. for 3 hours. Then, the target was cooled to 80° C. The target was opened under an argon atmosphere, and metallic rubidium was pumped out therefrom. Radiostrontium sorbed on the inner surface of the target shell which was made of stainless steel, and was withdrawn by filling-in the target with a 0.5 M HCl solution and allowing it to stand for 1 hour. Then, the solution was pumped out from the target, and the step of washing radiostrontium from the inner target shell surface was repeated. Both portions were combined, and secondary refining of the radiostrontium was carried out. Radionuclide impurities and stable impurities, such as $^{75}$Se, $^{74}$As, iron, nickel, and chromium, were removed on Chelex-100, Dowex 1×8, and Dowex 50×8 ion-exchange resins. The total Sr yield was 98 to 99%; radionuclide purity >99.9%.

EXAMPLE 4

Rubidium withdrawn from an irradiated target and containing 3.5% of oxygen was analyzed for the content of colloidal particles via measuring radiostrontium along the height of a vertically positioned glass container (Table 1). Following this, liquid rubidium which contained radiostrontium sorbed on colloidal particles, was stirred (for leveling out colloidal particle concentrations over the volume) and passed through a porous filter made of an inorganic material of titania (porous granules having diameters of 0.2 to 0.4 mm) at 30° C. Practically complete (>98%) extraction of radiostrontium from liquid rubidium was reached.

Thus, use of the present invention enhances the efficiency of radiostrontium production and simplifies radiostrontium extraction technology on account of carrying out radiostrontium sorption from liquid metallic rubidium directly on the inner shell surface of an irradiated target. Irradiated metallic rubidium removed from the target may be reused in radiostrontium production. Where rubidium circulating in the loop is bombarded, the process as claimed allows radiostrontium to be extracted either on the surface of materials immersed into liquid rubidium or on a porous membrane filter.

The invention claimed is:

1. A process for production of radiostrontium comprising the steps of:

bombarding a hermetically sealed target containing metallic rubidium inside a target shell, with a beam of accelerated protons;

melting of the rubidium inside the target shell after the bombarding thereof to yield a rubidium-containing liquid composition;

extracting radiostrontium from the rubidium-containing liquid composition via sorption at the temperature in the range of 275-350° C. on a sorbing surface of the target shell in contact with the rubidium-containing liquid composition;

removing the rubidium-containing liquid composition from the target shell; and washing radiostrontium with a solvent from the sorbing surface;

wherein the rubidium-containing liquid composition contains oxygen in an amount of 0.1 to 4 wt %.

2. The process according to claim 1, wherein the material of the rubidium target shell is stainless steel, tantalum, niobium, tungsten, molybdenum, nickel, or a noble metal or a mixture thereof.

3. The process according to claim 1, wherein the radiostrontium is washed from the inner target shell surface with organic alcohols, water, or hydrochloric acid or a mixture thereof.

4. A process for production of radiostrontium comprising the steps of:

bombarding a target made of metallic rubidium with a beam of accelerated protons;

melting of the rubidium to yield a rubidium-containing liquid composition;

extracting radiostrontium from the rubidium-containing liquid composition by circulating the rubidium-containing liquid composition during bombarding through a closed loop equipped with a trap wherein the loop is maintained at a temperature in the range from 10 to 200° C., wherein radiostrontium is extracted from the rubidium-containing liquid composition via sorption on the sorbing surface on parts of the trap heated to a temperature in the range of 220-350° C. which is in contact with the rubidium-containing liquid composition; and washing radiostrontium with a solvent from the surface of the parts of the trap wherein the rubidium-containing liquid composition contains oxygen in an amount of no more than 3.0 wt %.

5. The process according to claim 4 wherein the material of parts of the trap is stainless steel, tantalum, niobium, titanium, zirconium, tungsten, molybdenum, nickel, or a noble metal or a mixture thereof.

6. The process according to claim 4 wherein radiostrontium is washed from the surface of parts of the trap with organic alcohols, water, or hydrochloric acid or a mixture thereof.

7. A process for producing radiostrontium comprising the steps of:

bombarding a target made of metallic rubidium with a beam of accelerated protons;

melting of the rubidium to yield a rubidium-containing liquid composition;

extracting radiostrontium from the rubidium-containing liquid composition by circulating the rubidium-containing liquid composition during bombarding through a closed loop equipped with a trap wherein the loop is maintained at a temperature in the range from 10 to 38° C., and filtering the rubidium-containing liquid composition through a filtering unit made of a porous material comprising stainless steel, tantalum, niobium, titanium, zirconium, tungsten, molybdenum, nickel, or noble metals, wherein radiostrontium is extracted from the rubidium-containing liquid composition via sorption on a sorbing surface on parts of the filtering unit in contact with the rubidium-containing liquid composition;

washing radiostrontium with a solvent from the surface of the parts of the filtering unit, wherein the rubidium-containing liquid composition contains oxygen in an amount of 0.1 to 4.0 wt %.

8. The process according to claim 7 wherein radiostrontium is washed from the surface of the filtering unit with organic alcohols, water, or hydrochloric acid or a mixture thereof.

9. The process according to claim 7, wherein the target is hermetically sealed.

* * * * *